US007823556B2

(12) United States Patent
Lykowski et al.

(10) Patent No.: US 7,823,556 B2
(45) Date of Patent: Nov. 2, 2010

(54) ELECTRODE FOR AN IGNITION DEVICE

(75) Inventors: James D. Lykowski, Temperance, MI (US); Iryna Levina, Minneapolis, MN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 442 days.

(21) Appl. No.: 11/764,528

(22) Filed: Jun. 18, 2007

(65) Prior Publication Data

US 2007/0290591 A1 Dec. 20, 2007

Related U.S. Application Data

(60) Provisional application No. 60/814,842, filed on Jun. 19, 2006.

(51) Int. Cl.
*H01T 13/39* (2006.01)
*H01T 13/20* (2006.01)

(52) U.S. Cl. ..... 123/169 EL

(58) Field of Classification Search ..... 313/141, 313/118; 123/169 EL; 420/443, 445, 449, 420/442, 446; 148/426, 427, 428, 429
See application file for complete search history.

(56) References Cited

U.S. PATENT DOCUMENTS 2,482,580 A * 9/1949 Feichter ..... 501/131
3,907,552 A * 9/1975 Kennedy ..... 420/443
4,078,951 A 3/1978 Denzine et al.

(Continued)

FOREIGN PATENT DOCUMENTS

JP 2006316343 A * 11/2006

OTHER PUBLICATIONS

"Fatigue crack propagation of nickel-base superalloys at 650 deg C." NASA Report E-2778; NAS 1.1587150; NASA-TM-87150. Glenn Research Center. Oct. 1, 2985.

(Continued)

*Primary Examiner*—Stephen K Cronin
*Assistant Examiner*—Arnold Castro
(74) *Attorney, Agent, or Firm*—Robert L. Stearns; Dickinson Wright, PLLC

(57) ABSTRACT

An electrode for an ignition device is made from a Ni-based nickel-chromium-iron alloy which has improved resistance to high temperature oxidation, sulfidation, corrosive wear, deformation and fracture includes, by weight of the alloy: 14.5-25% chromium; 7-22% iron; 0.2-0.5% manganese; 0.2-0.5% silicon; 0.1-2.5% aluminum; 0.05-0.15% titanium; 0.01-0.1% total of calcium and magnesium; 0.005-0.5% zirconium; 0.001-0.01% boron, and the balance substantially Ni. It may also include at least one rare earth element selected from the group consisting of: yttrium, hafnium, lanthanum, cerium and neodymium in amounts ranging from 0.01-0.15% by weight, and incidental impurities, including cobalt, niobium, molybdenum, copper, carbon, lead, phosphorus or sulfur. These total of these impurities will typically be controlled to limits of 0.1% cobalt, 0.05% niobium, 0.05% molybdenum, 0.01% copper, 0.01% carbon, 0.005% lead, 0.005% phosphorus and 0.005% sulfur. The ignition device may be a spark plug which includes a ceramic insulator, a conductive shell, a center electrode disposed in the ceramic insulator having a terminal end and a sparking end with a center electrode sparking surface, and a ground electrode operatively attached to said shell having a ground electrode sparking surface, the center electrode sparking surface and the ground electrode sparking surface defining a spark gap therebetween. At least one of the center electrode or the ground electrode includes the solution-strengthened Ni-based nickel-chromium-iron alloy. The Ni-based nickel-chromium-iron alloy electrodes of the invention may also include a core with thermal conductivity greater than that of the Ni-based nickel-chromium-iron alloy, such as copper or silver or their alloys.

38 Claims, 2 Drawing Sheets

U.S. PATENT DOCUMENTS 4,415,530 A * 11/1983 Hunt ..... 420/453
4,439,498 A * 3/1984 Sadowski ..... 428/558
4,536,215 A 8/1985 Coad
4,631,169 A 12/1986 Isobe et al.
4,639,576 A * 1/1987 Shoemaker et al. .... 219/146.23
4,727,740 A * 3/1988 Yabuki et al. ..... 72/209
4,742,265 A 5/1988 Giachino et al.
4,784,830 A 11/1988 Ganesan et al.
4,844,864 A 7/1989 Frank
4,881,913 A * 11/1989 Mann ..... 445/7
5,755,897 A * 5/1998 Brill ..... 148/410
5,997,809 A 12/1999 Smith et al.
6,242,113 B1 6/2001 Kiser
6,287,398 B1 9/2001 Smith et al.
6,447,716 B1 * 9/2002 Cozar et al. ..... 420/445
6,603,244 B2 8/2003 Sugiyama et al.
6,750,597 B1 6/2004 Sakura
6,794,804 B2 * 9/2004 Kanao et al. ..... 313/141
6,885,135 B2 * 4/2005 Kanao et al. ..... 313/141
6,936,217 B2 * 8/2005 Quadadakkers et al. ..... 420/40
7,268,474 B2 * 9/2007 Hrastnik ..... 313/141
2002/0158559 A1 * 10/2002 Sugiyama et al. ..... 313/141
2005/0062386 A1 3/2005 Francesconi et al.

OTHER PUBLICATIONS

"Impurities and trace elements in nickel-base superalloys", Holt, R.T., Wallace, W.; International Metal Reviews. vol. 21, pp. 1-24 Mar. 1976.

* cited by examiner

FIG - 1
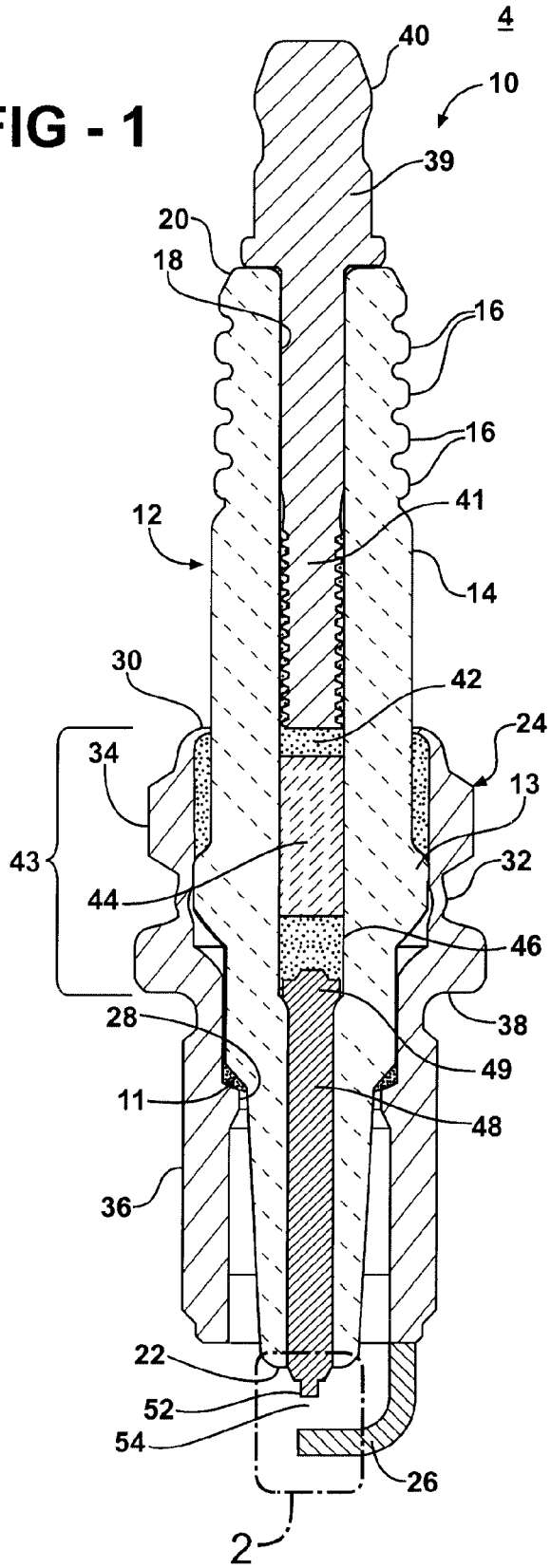
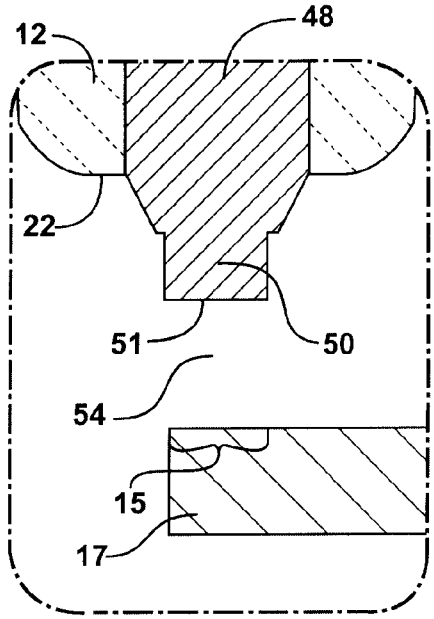
FIG - 2
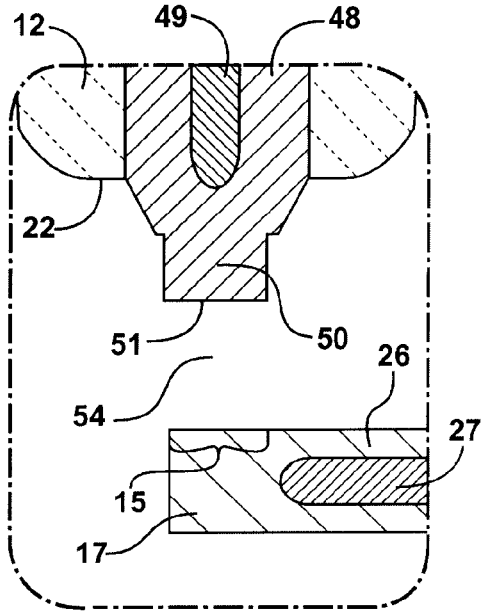
FIG - 3

FIG - 4
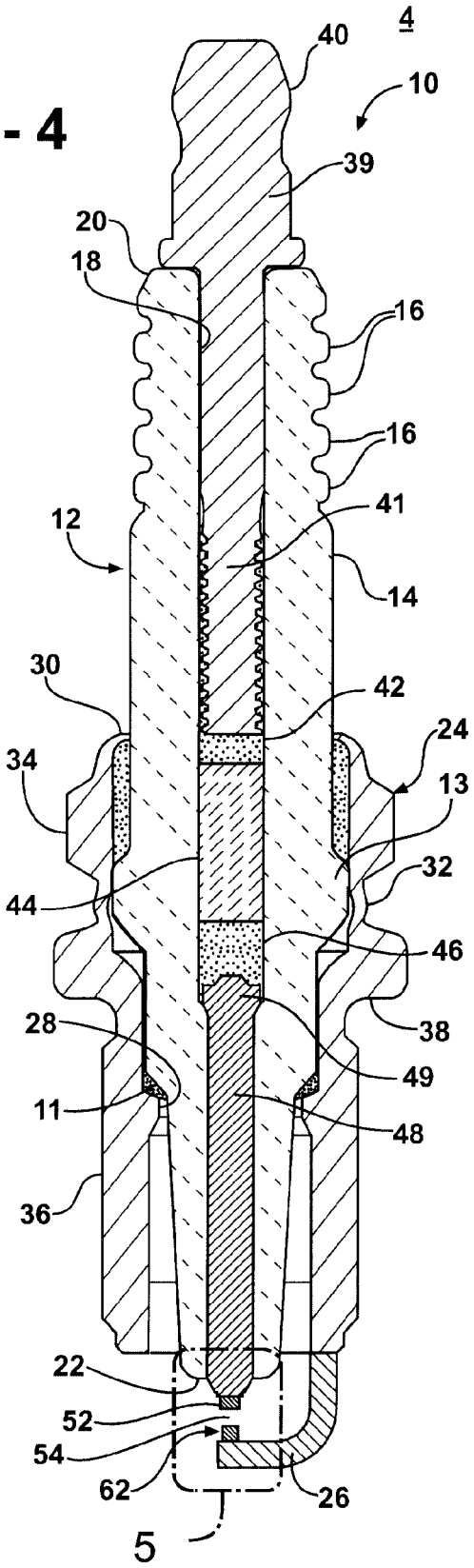
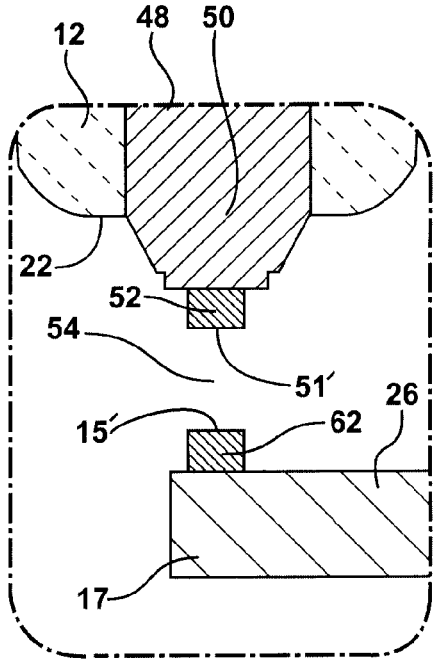
FIG - 5
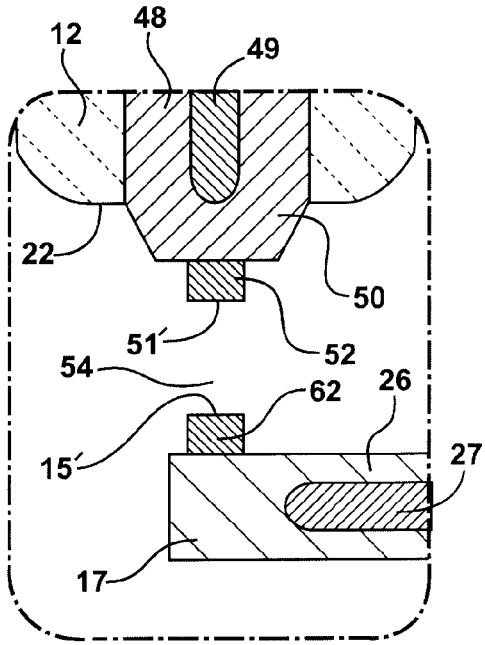
FIG - 6

ELECTRODE FOR AN IGNITION DEVICE

CROSS REFERENCE TO RELATED APPLICATIONS

The present application claims priority to U.S. provisional patent application Ser. No. 60/814,842 filed on Jun. 19, 2006, which is hereby incorporated herein by reference in its entirety.

BACKGROUND OF THE INVENTION

1. Field of the Invention

The invention relates to a high performance electrode made from a Ni-based nickel-chromium-iron alloy containing alloying additions of zirconium and boron that is temperature, oxidation, sulfidation and fracture resistant and, more particularly, toward an electrode for an ignition device, such as a spark plug for an internal combustion engine, furnace, or the like.

2. Related Art

A spark plug is a spark ignition device that extends into the combustion chamber of an internal combustion engine and produces a spark to ignite a mixture of air and fuel. Recent developments in engine technology are resulting in higher operating temperatures to achieve improved engine efficiency. These higher operating temperatures, however, are pushing the spark plug electrodes to the very limits of their material capabilities. Presently, Ni-based nickel-chromium-iron alloys specified under UNS N06600, such as those sold under the trade names Inconel 600®, Nicrofer 7615®, and Ferrochronin 600®, are in wide use as spark plug electrode materials.

As is well known, the resistance to high temperature oxidation of these Ni-based nickel-chromium-iron alloys decreases as their operating temperature increases. Since combustion environments are highly oxidizing, corrosive wear including deformation and fracture caused by high temperature oxidation and sulfidation can result and is particularly exacerbated at the highest operating temperatures. At the upper limits of operating temperature (e.g., 1400° F.), tensile, creep rupture and fatigue strength also have been observed to decrease significantly which can result in deformation, cracking and fracture of the electrodes. Depending on the electrode design, specific operating conditions and other factors, these high temperature phenomena may contribute individually and collectively to undesirable growth of the spark plug gap and diminished performance of the ignition device and associated engine. In extreme cases, failure of the electrode, ignition device and associated engine can result from electrode deformation and fracture resulting from these high temperature phenomena. These failure modes and effects can be particularly problematic in competitive applications, such as racing engines.

Accordingly, there is a need for high performance electrodes made from Ni-based nickel-chromium-iron alloys having improved resistance to high temperature oxidation, sulfidation and related corrosive wear, as well as improved high temperature tensile, creep rupture and fatigue strength and resistance to cracking and fracture.

SUMMARY OF THE INVENTION

In one aspect, the present invention includes an electrode for an ignition device having improved resistance to high temperature oxidation, sulfidation and related corrosive wear, as well as improved high temperature tensile, creep rupture and fatigue strength and resistance to cracking and fracture which is made from a solution-strengthened Ni-based nickel-chromium-iron alloy which includes, by weight: 14.5-25% chromium; 7-22% iron; 0.2-0.5% manganese; 0.2-0.5% silicon; 0.1-2.5% aluminum; 0.05-0.15% titanium; 0.01-0.1% total of calcium and magnesium; 0.005-0.5% zirconium; 0.001-0.01% boron and the balance substantially Ni. The addition of zirconium and boron has been observed to have a synergistic effect on the improvement in properties noted in solution-strengthened Ni-based nickel-chromium-iron alloys as compared to the improvements resulting from the addition of either of these elements separately. The zirconium and boron will generally be present in a weight ratio of Zr/B of about 5 to 150, and more particularly about 50 to 100, and most particularly about 70 to 80. While zirconium and boron may be present in any amounts consistent with the requirements of the electrode alloy, it is believed that zirconium in an amount of about 2.74% by weight or less and boron in an amount of about 3.50% by weight or less are generally believed to be the preferred upper limits for these constituents. It is also believed to be preferred that the amount of zirconium be greater than the amount of boron. In solution-strengthened Ni-based nickel-chromium-iron alloys generally, the use of zirconium in the range of 0.005-0.5% by weight of the alloy and boron in the range of 0.001-0.01% by weight of the alloy is believed to be particularly useful. In the alloy compositions described above which include manganese, silicon, aluminum, titanium, calcium and magnesium, the use of zirconium in the range of 0.005-0.15% by weight of the alloy and boron in the range of 0.001-0.01% by weight of the alloy is known to be particularly useful.

In another aspect, the present invention includes an electrode for an ignition device which is made from an Ni-based nickel-chromium-iron alloy which includes, by weight: chromium and iron, wherein the total of iron and chromium is at least about 21.5%, 0.005-2.74% zirconium, 0.001-3.50% boron and the balance substantially nickel.

In another aspect, the Ni-based nickel-chromium-iron alloys of the invention also may include at least one rare earth element selected from the group consisting of: yttrium, hafnium, lanthanum, cerium and neodymium, and related to this aspect, the rare earth element or elements are present in an amount of about 0.01-0.15% by weight of the alloy.

In yet another aspect, the Ni-based nickel-chromium-iron alloy of the invention also includes trace elements including at least one of cobalt, niobium, molybdenum, copper, carbon, lead, phosphorus or sulfur, and related to this aspect, the compositional limit of these trace elements are, in weight percent of the alloy: 0.1% for cobalt, 0.05% for niobium, 0.05% for molybdenum, 0.01% for copper, 0.01% for carbon, 0.005% for lead, 0.005% for phosphorus and 0.005% for sulfur.

In yet another aspect, the rare earth elements and the trace elements described above may both be present in the alloy, and related to this aspect may each be present in the amounts described above.

In yet another aspect, the ignition device is a spark plug which includes: a generally annular ceramic insulator; a conductive shell surrounding at least a portion of the ceramic insulator; a center electrode disposed in the ceramic insulator having a terminal end and a sparking end with a center electrode sparking surface; and a ground electrode operatively attached to the shell having a ground electrode sparking surface, the center electrode sparking surface and the ground electrode sparking surface defining a spark gap therebetween; wherein at least one of the center electrode or the ground electrode is a electrode made from the Ni-based nickel-chromium-iron alloy of the invention. The spark plug may also have a sparking tip attached to at least one of the center electrode or the ground electrode, wherein the sparking tip includes one of gold, a gold alloy, a platinum group metal or a tungsten alloy. Platinum group metal sparking tips may include at least one element selected from the group consisting of platinum, iridium, rhodium, palladium, ruthenium and rhenium, including alloys thereof in any combination. The platinum group metal may also include at least one element selected from the group consisting of nickel, chromium, iron, manganese, copper, aluminum, cobalt, tungsten, yttrium, zirconium, hafnium, lanthanum, cerium and neodymium as an alloying addition.

In yet another aspect, the spark plug may have the center electrode operable with one of a positive polarity or an negative polarity and the ground electrode operable at a ground potential.

Ni-based nickel-chromium-iron ignition device electrodes of the invention overcome certain of the disadvantages and shortcomings existing in prior art ignition devices, particularly spark plugs, by providing improved resistance to high temperature oxidation, sulfidation, corrosive wear and thermo-mechanically induced stress, deformation and fracture.

BRIEF DESCRIPTION OF THE DRAWINGS

These and other features and advantages of the present invention will become more readily appreciated when considered in connection with the following detailed description and appended drawings, wherein:

FIG. 1 is a partial cross-sectional view of an exemplary spark plug including shell and center electrodes manufactured from a Ni-based nickel-chromium-iron alloy according to the invention.

FIG. 2 is a cross-sectional view of region 2 of FIG. 1;

FIG. 3 is a cross-sectional view of region 3 illustrating an alternate electrode configuration to that shown in FIG. 1 having thermally conductive cores;

FIG. 4 is a partial cross-sectional view of an exemplary spark plug including shell and center electrodes manufactured from a Ni-based nickel-chromium-iron alloy according to the invention having a high temperature sparking tip;

FIG. 5 is a cross-sectional view of region 5 of FIG. 4; and

FIG. 6 is a cross-sectional view of region 6 of FIG. 4 illustrating an alternate electrode configuration to that shown in FIG. 4 having thermally conductive cores.

DETAILED DESCRIPTION OF THE PREFERRED EMBODIMENT

Referring to FIGS. 1-6, the present invention is an electrode for an ignition device 5 used for igniting a fuel/air mixture. The electrode may be used in any suitable ignition device 5, including various configurations of spark plugs, glow plugs, igniters and the like, but is particularly adapted for use in various spark plug electrode configurations. The electrodes of an ignition device such as a spark plug are essential to the function of the device. In spark ignition devices, such as spark plugs, the alloys used for the electrodes are exposed to the most extreme temperature, pressure, chemical corrosion and physical erosion conditions experienced by the device. These include exposure of the electrode alloys to numerous high temperature chemical reactant species associated with the combustion process which promote oxidation, sulfidation and other corrosion processes, as well as reaction of the plasma associated with the spark kernel and flame front which promote erosion of the spark surface of the electrode. The electrodes are also subject to thermo-mechanical stresses associated with the cyclic exposure to extreme temperatures, particularly to the extent corrosion processes form corrosion products on the electrode surfaces having different physical and mechanical properties, such as coefficients of thermal expansion, than the electrode alloy. Also, where noble metal spark tips are mechanically deformed, welded or otherwise attached to the electrode ends as sparking surfaces, there are additional cyclic thermo-mechanical stresses associated with the mismatch in the thermal expansion coefficients of the noble metal tip and the electrode materials which can result in various high temperature creep deformation, cracking and fracture phenomena, resulting in failure of the noble metal tips and electrodes. All of these represent processes by which the properties of the electrodes may be degraded, particularly they can result in changes in the spark gap and thus the formation, location, shape, duration and other characteristics of the spark, which in turn affects the combustion characteristics of the fuel/air mixture and performance characteristics of the engine. The present invention has improved resistance to these degradation processes over that of commonly used electrode alloys, such as various UNS N06600 alloys, including those sold under the trademarks Inconel® 600, Ferrochronin® 600, Nichrofer® 7615 and the like. These alloys are frequently used as center and ground electrode materials for spark plugs.

Referring to FIGS. 1-3, a spark plug having electrodes in accordance with the subject invention is generally shown at 10. The spark plug 10 includes a generally annular ceramic insulator, generally indicated at 12, which includes aluminum oxide or another suitable electrically insulating material having a specified dielectric strength, high mechanical strength, high thermal conductivity, and excellent resistance to thermal shock. The insulator 12 may be press molded from a ceramic powder in a green state and then sintered at a high temperature sufficient to densify and vitrify the ceramic powder. The insulator 12 has an outer surface which may include a partially exposed upper portion 14 to which a rubber or other insulating spark plug boot (not shown) surrounds and grips to electrically isolate an electrical connection of the terminal end 20 of the spark plug with an ignition wire and system (not shown). The exposed mast portion 14 may include a series of ribs 16 or other surface glazing or features to provide added protection against spark or secondary voltage flash-over and to improve the gripping action of the mast portion with the spark plug boot. The insulator 12 is of generally tubular or annular construction, including a central passage 18 extending longitudinally between an upper terminal end 20 and a lower core nose end 22. The central passage 18 generally has a varying cross-sectional area, generally greatest at or adjacent the terminal end 20 and smallest at or adjacent the core nose end 22.

An electrically conductive metal shell is generally indicated at 24. Metal shell 24 may be made from any suitable metal, including various coated and uncoated steel alloys. The shell 24 has a generally annular interior surface which surrounds and is adapted for sealing engagement with the exterior surface of the mid and lower portions of the insulator 12 and includes at least one attached ground electrode 26 which is maintained at ground potential. While ground electrode 26 is depicted in a commonly used single L-shaped style, it will be appreciated that multiple ground electrodes of straight, bent, annular, trochoidal and other configurations can be substituted depending upon the intended application for the spark plug 10, including two, three and four electrode configurations, and those where the electrodes are joined together by annular rings and other structures used to achieve particular sparking surface configurations. The ground electrode 26 has one or more ground electrode sparking surface 15, on a sparking end 17 proximate to and partially bounding a spark gap 54 located between ground electrode 26 and a center electrode 48 which also has an associated center electrode sparking surface 51. The spark gap 54 may constitute an end gap, side gap or surface gap, or combinations thereof, depending on the relative orientation of the electrodes and their respective sparking ends and surfaces. Ground electrode sparking surface 15 and center electrode sparking surface 51 may each have any suitable cross-sectional shape, including round, rectangular, square and other shapes, and these shapes may be different.

The shell 24 is generally tubular or annular in its body section and includes an internal lower compression flange 28 adapted to bear in pressing contact against a small mating lower shoulder 11 of the insulator 12. The shell 24 generally also includes an upper compression flange 30, which is crimped or formed over during the assembly operation to bear on a large upper shoulder 13 of the insulator 12. Shell may also include a deformable zone 32 which is designed and adapted to collapse axially and radially inwardly in response to heating of deformable zone 32 and associated application of an overwhelming axial compressive force during or subsequent to the deformation of upper compression flange 30 in order to hold shell 34 in a fixed axial position with respect to insulator 12 and form a gas tight radial seal between insulator 12 and shell 24. Gaskets, cement, or other sealing compounds can also be interposed between insulator 12 and shell 24 to perfect a gas-tight seal and to improve the structural integrity of assembled spark plug 10.

Shell 24 may be provided with a tool receiving hexagon 34 or other feature for removal and installation of the spark plug in a combustion chamber opening. The feature size will preferably conform with an industry standard tool size of this type for the related application. Of course, some applications may call for a tool receiving interface other than a hexagon, such as slots to receive a spanner wrench, or other features such as are known in racing spark plug and other applications. A threaded section 36 is formed on the lower portion of metal shell 24, immediately below a sealing seat 38. The sealing seat 38 may be paired with a gasket (not shown) to provide a suitable interface against which the spark plug 10 seats and provides a hot gas seal of the space between the outer surface of the shell 24 and the threaded bore in the combustion chamber opening. Alternately, the sealing seat 38 may be designed as a tapered seat located along the lower portion of the shell 24 to provide a close tolerance and a self-sealing installation in a cylinder head which is also designed with a mating taper for this style of spark plug seat.

An electrically conductive terminal stud 40 is partially disposed in the central passage 18 of the insulator 12 and extends longitudinally from an exposed top post 39 to a bottom end 41 embedded partway down the central passage 18. Top post connects to an ignition wire (not shown) which is typically embedded in an electrically isolating boot as described herein and receives timed discharges of high voltage electricity required to fire the spark plug 10 by generating a spark in spark gap 54.

Bottom end 41 of the terminal stud 40 is embedded within a conductive glass seal 42, forming the top layer of a composite three-layer suppressor-seal pack 43. Conductive glass seal 42 functions to seal the bottom end of terminal stud 40 and electrically connect it to a resistor layer 44. This resistor layer 44, which comprises the center layer of the three-layer suppressor-seal pack, can be made from any suitable composition known to reduce electromagnetic interference ("EMI"). Depending upon the recommended installation and the type of ignition system used, such resistor layers 44 may be designed to function as a more traditional resistor-suppressor or, in the alternative, as an inductive-suppressor, or a combination thereof. Immediately below the resistor layer 44, another conductive glass seal 46 establishes the bottom or lower layer of the suppressor-seal pack 43 and electrically connects terminal stud 40 and suppressor-seal pack 43 to the center electrode 48. Top layer 42 and bottom layer 46 may be made from the same conductive material or different conductive materials. Many other configurations of glass and other seals and EMI suppressors are well-known and may also be used in accordance with the invention. Accordingly, electrical charge from the ignition system travels through the bottom end of the terminal stud 40 to the top layer conductive glass seal 42, through the resistor layer 44, and into the lower conductive glass seal layer 46.

Conductive center electrode 48 is partially disposed in the central passage 18 and extends longitudinally from its head 49 which is encased in the lower glass seal layer 46 to its sparking end 50 proximate ground electrode 26. Center electrode sparking surface 51 is located on sparking end 50 and is located opposite ground electrode sparking surface 15, thereby forming a spark gap 54 in the space between them. The suppressor-seal pack electrically interconnects terminal stud 40 and center electrode 48, while simultaneously sealing the central passage 18 from combustion gas leakage and also suppressing radio frequency noise emissions from the spark plug 10 during its operation. As shown, center electrode 48 is preferably a one-piece structure extending continuously and uninterrupted between its head and its sparking end 50. It will be readily understood and within the scope of this invention that the polarity of the center electrode 48 during operation of the spark plug 10 may be either positive or negative such that the center electrode 48 has a potential which is either higher or lower than ground potential.

This is a representative construction of spark plug 10, but it will be readily appreciated that other spark plug 10 or ignition device 5 constructions using insulator 12, shell 24 and electrodes 26 and 48 are possible in accordance with the present invention.

Preferably both, but at least one, of the center 48 and shell 26 electrodes are fabricated from Ni-based nickel-chromium-iron alloys which has been specially formulated by the addition of zirconium and boron to have improved resistance to the degradation processes described above over that of similar alloy formulations which do not incorporate these improvements. The general category of alloys to which this invention applies are commonly referred to generally as Ni-based superalloys due to their superior high temperature properties, including mechanical strength and resistance to certain high temperature oxidation and corrosion processes. Specifically, the invention includes solution-strengthened Ni-based superalloys that include chromium and iron, such as alloys comprehended by the Unified Numbering System for Metals and Alloys (UNS) specification N06600, which includes alloys sold under the trademarks Inconel 600®, Nicrofer 7615®, and Ferrochronin 600®, and which also incorporate zirconium and boron to the alloy formulation to produce improved resistance to the degradation processes described herein over similar alloy formulations which do not include these alloying additions. It is believed that the electrodes of the invention include those made from solution-strengthened Ni-based nickel-chromium-iron alloys which comprise, by weight: chromium and iron, where the total of iron and chromium is at least about 21.5%, 0.005-2.74% zirconium, 0.001-3.50% boron and the balance substantially nickel, which may include nickel-chromium-iron alloy formulations, including commercial alloys with UNS designations outside those specified in UNS N06600. It is also believed to include such alloys which have at least one element selected from the group consisting of manganese, silicon, aluminum, titanium, calcium and magnesium. Generally, the small amounts of zirconium and boron added are substituted for an equivalent amount of nickel to produce this improvement, but substitution for other constituents, such as chromium or iron or another constituent or constituents listed above is also possible.

Particularly useful embodiments of these electrodes are believed to include those made from Ni-based nickel-chromium-iron alloys which include, by weight: 14.5-25% chromium; 7-22% iron; 0.2-0.5% manganese; 0.2-0.5% silicon; 0.1-2.5% aluminum; 0.05-0.15% titanium; 0.01-0.1% total combined calcium and magnesium; 0.005-0.5% zirconium; 0.001-0.01% boron, and the balance substantially Ni, with such alloys having zirconium present in the range of 0.005-0.15% known to be particularly useful for providing the improvements to the high temperature properties described herein. While the balance of alloys of the invention will be substantially Ni, the incorporation of small amounts of one or more additional alloy constituents which do not significantly diminish the high temperature properties noted herein is not precluded, including the alloying additions and trace elements described herein. The limit on the total of calcium and magnesium means that either of these elements may be present separately or may both be present, with their total being in the range of 0.01-0.1% by weight of the alloy. When both are present, it is generally preferred that the amount of each be within the range of 0.005-0.05% by weight of the alloy. Alloy constituent percentages given herein are percentages by weight of the alloy unless otherwise stated.

The zirconium and boron are generally included in amounts such that the weight ratio of Zr/B ranges from about 5 to 150. However, a more preferred range of this ratio is about 50 to 100, and a most preferred range being about 70 to 80. While zirconium and boron may present in any amounts consistent with the other requirements of the electrode alloy, it is believed that zirconium in an amount of about 2.74% by weight or less and boron in an amount of about 3.50% by weight or less are the preferred upper limits for these constituents. It is also believed to be preferred that the amount of zirconium be greater than the amount of boron. In solution-strengthened Ni-based nickel-chromium-iron alloy alloys generally, the use of zirconium in the range of 0.005-0.5% by weight of the alloy and boron in the range of 0.001-0.01% by weight of the alloy is believed to be particularly useful. In the alloy compositions described above which include manganese, silicon, aluminum, titanium, calcium and magnesium, the use of zirconium in the range of 0.005-0.15% by weight of the alloy and boron in the range of 0.001-0.01% by weight of the alloy is known to be particularly useful. Boron and zirconium are known as grain boundary strengtheners. They segregate to the grain boundaries and serve to stabilize them increasing grain boundary strength and ductility, retarding grain boundary diffusion and sliding and delaying intergranular cracking caused be environmental and mechanical factors under the operating conditions of the electrodes, thereby inhibiting high temperature grain growth and enhancing the resistance of these alloys to high temperature creep, deformation, environmental cracking and various fracture phenomena, such as stress rupture. The performance improvements associated with the addition of zirconium and boron are synergistic, that is they are greater than the improvements that result when either zirconium or boron are added to these alloys separately.

As a further improvement to the degradation resistance of these alloys, particularly by improvement of the high temperature oxidation resistance, the electrode alloy material compositions described above may also include at least one rare earth element as an alloying addition. For purposes of this application, the definition of rare earth elements also includes yttrium and hafnium which are reactive transition metals but which are believed to also produce improvements to these solution-strengthened Ni-based nickel-chromium-iron alloys similar to those produced by the addition of the rare earth element alloying additions. More specifically, the rare earth elements will include at least one element selected from the group consisting of yttrium, hafnium, lanthanum, cerium, and neodymium. However, any combination of rare earth element alloying additions is comprehended within the scope of this invention. Also more specifically, the compositional range of all rare earth element alloying additions is preferably limited to 0.1-0.2% by weight of the alloy.

The electrode alloy material may also include trace amounts other elements. These trace elements may be incidental impurity elements. Typically incidental impurities are associated with the processes used to manufacture the primary alloy constituent materials or the processes used to form the electrode alloy. However, if the purity of the other electrode constituents and the manufacturing process is controlled, these trace elements need not be incidental and their presence or absence and relative amounts may be controlled. The trace elements may include cobalt, niobium, molybdenum, copper, carbon, lead, phosphorus and sulfur in any combination. The electrode alloy material of the invention will typically include at least one of these elements, with the total number of them typically associated with the sources and manufacturing methods used to produce the constituents noted. Some of these elements, including cobalt, niobium, molybdenum, copper and carbon may have a neutral to slightly positive effect on the improvements to the high temperature properties described herein, while others may have a slightly negative effect on them, including lead, phosphorus and sulfur. To the extent these elements are present in the alloy, regardless of whether they have a positive or negative effect on its high temperature properties, it is preferred to limits their amounts as follows, by weight of the Ni-based nickel-chromium-iron alloy: cobalt 0.1% max, niobium 0.05% max, molybdenum 0.05% max, copper 0.01% max, carbon 0.01% max, lead 0.005% max, phosphorus 0.005% max, sulfur 0.005% max.

Spark plug ground electrodes 26 and center electrodes 48 made from the Ni-based nickel-chromium-iron alloy composition as described have improved resistance to oxidation, sulfidation and associated corrosive wear, as well as improved resistance to cracking and fracture associated with thermo-mechanical stresses in the extremely adverse environment of the combustion chamber of an internal combustion engine.

As shown in FIG. 3, in an alternate electrode configuration, either one or both of the ground electrode 26 and center electrode 48 can be provided with thermally conductive cores 27, 49, respectively, made from material of high thermal conductivity (e.g., ≧250 W/M*° K.) such as copper or silver or various alloys of either of them. Highly thermally conductive cores serve as heat sinks and help to draw heat away from the spark gap 54 region, thereby lowering the operating temperature of the electrodes in this region and further improving their performance and resistance to the degradation processes described herein.

As shown in FIGS. 4-6, the spark plug 10 may also incorporate on the sparking ends of either or both of the ground electrode 26 or center electrode 48 a firing tip 62,52, respectively, of a different high temperature material that has either improved spark performance or resistance to the degradation processes described, or both of them. This may include all manner of noble and non-noble metal firing tips. Center electrode 48 firing tip 52 is located on sparking end 50 of this electrode and has a sparking surface 51'. Ground electrode 26 firing tip 62 is located on sparking end 17 of this electrode and has a sparking surface 15'. Firing tips 52,62, when used, include respective sparking surfaces 51', 15' for the emission of electrons across the spark gap 54. Firing tip 52 for the center electrode 48 and firing tip 62 for ground electrode 26 can each be made and joined according to any of a number of known techniques, including the formation and attachment, or the reverse, of various pad-like, wire-like or rivet-like firing tips by various combinations of resistance welding, laser welding, or combinations thereof. Firing tips 52, 62 may be made from gold or gold alloys, including Au—Pd alloys, such as Au-40Pd (in weight percent) alloys. Firing tips 52,62 may also be made from any of the known pure metals or alloys of the platinum group metals, including: platinum, iridium, rhodium, palladium, ruthenium and rhenium, and various alloy combinations thereof in any combination. For purposes of this application, rhenium is also included within the definition of platinum group metals based on its high melting point and other high temperature characteristics similar to those of certain of the platinum group metals. Additional alloying elements for use in firing tips 52,62 may include, but are not limited to, nickel, chromium, iron, manganese, copper, aluminum, cobalt, zirconium, tungsten and rare earth elements including yttrium, hafnium, lanthanum, cerium, and neodymium. In fact, any material that provides suitable spark erosion corrosion performance in the combustion environment may be suitable for use as firing tips 52,62. Firing tips 52,62 may also be made from various tungsten alloys, including W—Ni, W—Cu and W—Ni—Cu alloys.

The subject Ni-based nickel-chromium-iron electrode materials are also beneficial when a firing tip 52,62 or other feature is welded to an electrode body made thereof. It provides improved strength and durability and resistance to fracture of the weld at high temperatures. While the subject Ni-based nickel-chromium-iron electrode material has been described for use in the particular application of a shell 26 and/or center 48 electrode for a spark plug 10, it will be appreciated that other uses and applications for the subject alloy to electrodes for other ignition devices will be readily appreciated by those of skill in the art due to the invented material's superior resistance to high temperature oxidation and sulfidation, high temperature mechanical strength, and improvements in resistance to cracking and fracture of weld attachments due to thermo-mechanically induced stresses, particularly weld attachments associated with various firing tip configurations.

Obviously, many modifications and variations of the present invention are possible in light of the above teachings. It is, therefore, to be understood that within the scope of the appended claims, the invention may be practiced otherwise than as specifically described.

What is claimed is:

1. An electrode for an ignition device, said electrode comprising an alloy which comprises, by weight: 14.5-25% chromium; 7-22% iron; 0.2-0.5% manganese; 0.2-0.5% silicon; 0.1-2.5% aluminum; 0.05-0.15% titanium; 0.01-0.1% total of calcium and magnesium; 0.005-0.5% zirconium; 0.001-0.01% boron and the balance substantially Ni.

2. The electrode of claim 1, wherein said alloy further comprises at least one rare earth element selected from the group consisting of: yttrium, hafnium, lanthanum, cerium and neodymium.

3. The electrode of claim 2, wherein said rare earth element is present in an amount of 0.1-0.2% by weight.

4. The electrode of claim 1, wherein said alloy further comprises at least one of cobalt, niobium, molybdenum, copper, carbon, lead, phosphorus or sulfur as a trace element.

5. The electrode of claim 4, wherein, to the extent present, said trace element has a compositional limit of, in weight percent: 0.1% for cobalt, 0.05% for niobium, 0.05% for molybdenum, 0.01% for copper, 0.01% for carbon, 0.005% for lead, 0.005% for phosphorus and 0.005% for sulfur.

6. The electrode of claim 2, wherein said alloy further comprises at least one of cobalt, niobium, molybdenum, copper, carbon, lead, phosphorus or sulfur as a trace element.

7. The electrode of claim 6, wherein, to the extent present, said trace element has a compositional limit of, in weight percent: 0.1% for cobalt, 0.05% for niobium, 0.05% for molybdenum, 0.01% for copper, 0.01% for carbon, 0.005% for lead, 0.005% for phosphorus and 0.005% for sulfur.

8. The electrode of claim 1, wherein said ignition device is a spark plug further comprising:

a generally annular ceramic insulator;

a conductive shell surrounding at least a portion of said ceramic insulator;

a center electrode disposed in said ceramic insulator having a terminal end and a sparking end with a center electrode sparking surface; and a ground electrode operatively attached to said shell having a ground electrode sparking surface located proximate said center electrode sparking surface, said center electrode sparking surface and said ground electrode sparking surface defining a spark gap therebetween; wherein at least one of said center electrode or said ground electrode is said electrode.

9. The electrode of claim 8, wherein said center electrode or is operable with one of a positive polarity or a negative polarity and said ground electrode is operable at a ground potential.

10. The electrode of claim 8, further comprising a sparking tip attached to at least one of said center electrode or said ground electrode, wherein said sparking tip comprises one of gold, a gold alloy, a platinum group metal or a tungsten alloy.

11. The electrode of claim 10, wherein said platinum group metal comprises at least one element selected from the group consisting of platinum, iridium, rhodium, palladium, ruthenium and rhenium.

12. The electrode of claim 11, wherein said platinum group metal further comprises at least one element selected from the group consisting of nickel, chromium, iron, manganese, copper, aluminum, cobalt, tungsten, yttrium, zirconium, hafnium, lanthanum, cerium and neodymium.

13. An electrode for an ignition device, said electrode comprising an alloy consisting essentially of, by weight: 14.5-25% chromium; 7-22% iron; 0.2-0.5% manganese; 0.2-0.5% silicon; 0.1-2.5% aluminum; 0.05-0.15% titanium; 0.01-0.1% total of calcium and magnesium; 0.005-0.5% zirconium; 0.001-0.01% boron, and the balance Ni and incidental impurities.

14. The electrode of claim 13, wherein said incidental impurities comprise at least one of cobalt, niobium, molybdenum, copper, carbon, lead, phosphorus or sulfur.

15. The electrode of claim 14, wherein, to the extent present, said incidental impurities have compositional limits of, in weight percent: 0.1% for cobalt, 0.05% for niobium, 0.05% for molybdenum, 0.01% for copper, 0.01% for carbon, 0.005% for lead, 0.005% for phosphorus and 0.005% for sulfur.

16. The electrode of claim 13, further comprising at least one rare earth element selected from the group consisting of: yttrium, hafnium, lanthanum, cerium and neodymium.

17. The electrode of claim 16, wherein said rare earth element is present in an amount of 0.1-0.2% by weight.

18. The electrode of claim 13, wherein said ignition device is a spark plug, further comprising:

a generally annular ceramic insulator;

a conductive shell surrounding at least a portion of said ceramic insulator;

a center electrode disposed in said ceramic insulator having a terminal end and a sparking end with a center electrode sparking surface; and a ground electrode operatively attached to said shell having a ground electrode sparking surface located proximate said center electrode sparking surface, said center electrode sparking surface and said ground electrode sparking surface defining a spark gap therebetween; wherein at least one of said center electrode or said ground electrode is said electrode.

19. The electrode of claim 18, further comprising a sparking tip attached to at least one of said center electrode or said ground electrode, wherein said sparking tip comprises one of gold, a gold alloy, a platinum group metal or a tungsten alloy.

20. The electrode of claim 19, wherein said platinum group metal comprises at least one element selected from the group consisting of platinum, iridium, rhodium, palladium, ruthenium and rhenium.

21. The electrode of claim 20, wherein said platinum group metal further comprises at least one element selected from the group consisting of nickel, chromium, iron, manganese, copper, aluminum, cobalt, tungsten, yttrium, zirconium, hafnium, lanthanum, cerium and neodymium.

22. An electrode for an ignition device, said electrode comprising an alloy consisting essentially of, by weight: 14.5-25% chromium; 7-22% iron; 0.2-0.5% manganese; 0.2-0.5% silicon; 0.1-2.5% aluminum; 0.05-0.15% titanium; 0.01-0.1% total of calcium and magnesium; 0.005-0.5% zirconium; 0.001-0.01% boron; at least one rare earth element selected from the group consisting of: yttrium, hafnium, lanthanum, cerium and neodymium; and the balance Ni and incidental impurities.

23. The electrode of claim 22, wherein said rare earth element is present in an amount of 0.1-0.2% by weight.

24. The electrode of claim 22, wherein, to the extent present, said incidental impurities comprise at least one of cobalt, niobium, molybdenum, copper, carbon, lead, phosphorus or sulfur.

25. The electrode of claim 22, wherein, to the extent present, said incidental impurities have compositional limits of, in weight percent: 0.1% cobalt, 0.05% niobium, 0.05% molybdenum, 0.01% copper, 0.01% carbon, 0.005% lead, 0.005% phosphorus and 0.005% sulfur.

26. The electrode of claim 22, wherein said center electrode or is operable with one of a positive polarity or a negative polarity and said ground electrode is operable at a ground potential.

27. The electrode of claim 22, further comprising:

a generally annular ceramic insulator;

a conductive shell surrounding at least a portion of said ceramic insulator;

a center electrode disposed in said ceramic insulator having a terminal end and a sparking end with a center electrode sparking surface; and a ground electrode operatively attached to said shell having a ground electrode sparking surface located proximate said center electrode sparking surface, said center electrode sparking surface and said ground electrode sparking surface defining a spark gap therebetween; wherein at least one of said center electrode or said ground electrode is said electrode.

28. The electrode of claim 27, further comprising a sparking tip attached to at least one of said center electrode or said ground electrode, wherein said sparking tip comprises one of gold, a gold alloy, a platinum group metal or a tungsten alloy.

29. The electrode of claim 28, wherein said platinum group metal comprises at least one element selected from the group consisting of platinum, iridium, rhodium, palladium, ruthenium and rhenium.

30. The electrode of claim 29, wherein said platinum group metal further comprises at least one element selected from the group consisting of nickel, chromium, iron, manganese, copper, aluminum, cobalt, tungsten, yttrium, zirconium, hafnium, lanthanum, cerium and neodymium.

31. An electrode for an ignition device, said electrode comprising an alloy which comprises, by weight: chromium and iron, wherein the total of iron and chromium is at least about 21.5%, 0.005-2.74% zirconium, 0.001-3.50% boron and the balance substantially nickel.

32. The electrode of claim 31, wherein said alloy comprises 0.005-0.5% zirconium and 0.001-0.10% boron.

33. The electrode of claim 31, further comprising at least one element selected from the group consisting of manganese, silicon, aluminum, titanium, calcium and magnesium.

34. The electrode of claim 31, further comprising at least one rare earth element selected from the group consisting of yttrium, hafnium, lanthanum, cerium and neodymium.

35. The electrode of claim 31, further comprising:

a generally annular ceramic insulator;

a conductive shell surrounding at least a portion of said ceramic insulator;

a center electrode disposed in said ceramic insulator having a terminal end and a sparking end with a center electrode sparking surface; and a ground electrode operatively attached to said shell having a ground electrode sparking surface located proximate said center electrode sparking surface, said center electrode sparking surface and said ground electrode sparking surface defining a spark gap therebetween; wherein at least one of said center electrode or said ground electrode is said electrode.

36. The electrode of claim 35, further comprising a sparking tip attached to at least one of said center electrode or said ground electrode, wherein said sparking tip comprises one of gold, a gold alloy, a platinum group metal or a tungsten alloy.

37. The electrode of claim 28, wherein said sparking tip is a platinum group metal comprising at least one element selected from the group consisting of platinum, iridium, rhodium, palladium, ruthenium and rhenium.

38. The electrode of claim 37, wherein said platinum group metal further comprises at least one element from the group consisting of nickel, chromium, iron, manganese, copper, aluminum, cobalt, tungsten, yttrium, zirconium, hafnium, lanthanum, cerium and neodymium.

* * * * *